US006328643B1

(12) United States Patent
Huber

(10) Patent No.: US 6,328,643 B1
(45) **Date of Patent: *Dec. 11, 2001**

(54) ERGONOMICALLY FRIENDLY RANDOM ORBITAL SANDER CONSTRUCTION

(75) Inventor: Paul W. Huber, Lancaster, NY (US)

(73) Assignee: Hao Chien Chao, South Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/621,920

(22) Filed: Jul. 24, 2000

Related U.S. Application Data

(60) Continuation of application No. 09/394,571, filed on Sep. 10, 1999, now Pat. No. 6,149,511, which is a division of application No. 08/787,873, filed on Jan. 23, 1997, now Pat. No. 6,004,197.

(51) Int. Cl.[7] ..... B24B 23/00
(52) U.S. Cl. ..... 451/357; 451/456; 451/359
(58) Field of Search ..... 451/456, 357, 451/359, 344, 353

(56) References Cited

U.S. PATENT DOCUMENTS

| | | | |
|---|---|---|---|
| D. 269,845 | 7/1983 | Hutchins | D8/62 |
| D. 314,125 | 1/1991 | Ogawa et al. | D8/62 |
| D. 326,398 | 5/1992 | Fushiya et al. | D8/62 |
| D. 332,734 | 1/1993 | Fushiya et al. | D8/62 |
| D. 334,126 | 3/1993 | Huber et al. | D8/62 |
| D. 347,561 | 6/1994 | Huber et al. | D8/62 |
| D. 350,266 | 9/1994 | Huber et al. | D8/62 |
| D. 350,886 | 9/1994 | Huber et al. | D8/62 |
| 2,114,966 | 4/1938 | Myers | 51/177 |
| 3,673,744 | 7/1972 | Oimoen | 51/177 |
| 3,785,092 | 1/1974 | Hutchins | 51/170 |
| 3,793,781 | 2/1974 | Hutchins | 51/170 |
| 3,970,110 | 7/1976 | Schaedler et al. | 137/613 |
| 4,071,981 | 2/1978 | Champayne | 51/170 |
| 4,268,233 | 5/1981 | Fernstrom | 418/270 |
| 4,414,781 | 11/1983 | Overy et al. | 51/170 |
| 4,467,565 | 8/1984 | Wallace et al. | 51/170 |
| 4,531,329 | 7/1985 | Huber | 51/273 |
| 4,660,329 | 4/1987 | Hutchins | 51/170 |
| 4,671,019 | 6/1987 | Hutchins | 51/170 |
| 4,854,085 | 8/1989 | Huber | 51/170 |
| 4,879,847 | 11/1989 | Butzen et al. | 51/170 |
| 5,040,340 | 8/1991 | Bischof et al. | 51/170 |
| 5,105,585 | 4/1992 | Hampl et al. | 51/170 |
| 5,125,190 | 6/1992 | Buser et al. | 51/273 |
| 5,228,244 | 7/1993 | Chu | 51/273 |
| 5,319,888 | 6/1994 | Huber et al. | 51/170 |

(List continued on next page.)

OTHER PUBLICATIONS

The Aro Corporation, Operator's Manual, Random Orbital Sander, Oct. 16, 1990—4 pages.

*Primary Examiner*—Eileen P. Morgan
(74) *Attorney, Agent, or Firm*—Joseph P. Gastel

(57) ABSTRACT

A random orbital sander including a housing, a motor having a vertical axis in the housing, a pad coupled to the motor, a face on the pad extending substantially perpendicularly to the vertical axis, a shroud surrounding the pad, an opening in the shroud, and a dust discharge tube having an inner end in communication with the opening and an outer end on the dust discharge end extending at an acute angle to the face of the pad. The sander has a height of between 83 and 86 millimeters and can weight between 0.8 and 0.75 kilograms. The outer end of the dust discharge tube can extend between about 120 and 157 millimeters from the vertical centerline. A compressed air valve including a first cylindrical wall, a first bore in the first wall, a valve having a base with a second cylindrical wall in engagement with the first cylindrical wall, a second bore in the cylindrical wall, and an inclined surface in the second wall in communication with the second bore.

16 Claims, 10 Drawing Sheets

U.S. PATENT DOCUMENTS

| | | | |
|---|---|---|---|
| 5,411,386 | 5/1995 | Huber et al. | 418/149 |
| 5,531,639 | 7/1996 | Catalfamo | 451/456 |
| 5,536,199 | 7/1996 | Urakami | 451/91 |
| 5,538,040 | 7/1996 | Huber et al. | 137/614.19 |
| 5,595,530 | 1/1997 | Heidelberger | 451/356 |
| 5,713,785 | 2/1998 | Nishio | 451/451 |
| 5,791,979 | 8/1998 | Duncan et al. | 451/456 |
| 5,879,228 | 3/1999 | Sun | 451/359 |
| 5,919,085 | 7/1999 | Izumisawa | 451/359 |
| 5,941,765 | 8/1999 | Taylor | 451/359 |
| 6,149,511 * | 11/2000 | Huber | 451/357 |

* cited by examiner 10
11
12
13
15
17
105
106
108
87
80
90
3
1A 10
11
12
13
14
15
17
22
71
81
87
80
93
94
95
105
106
107
108
110
2A
3
a
b 80
87
90
109
12
92
91
93
94
95
11
81
89
86
42
83
85
147
145
107
143
142
144
105
84
88
17
10
15
22
13
14
70
a
b

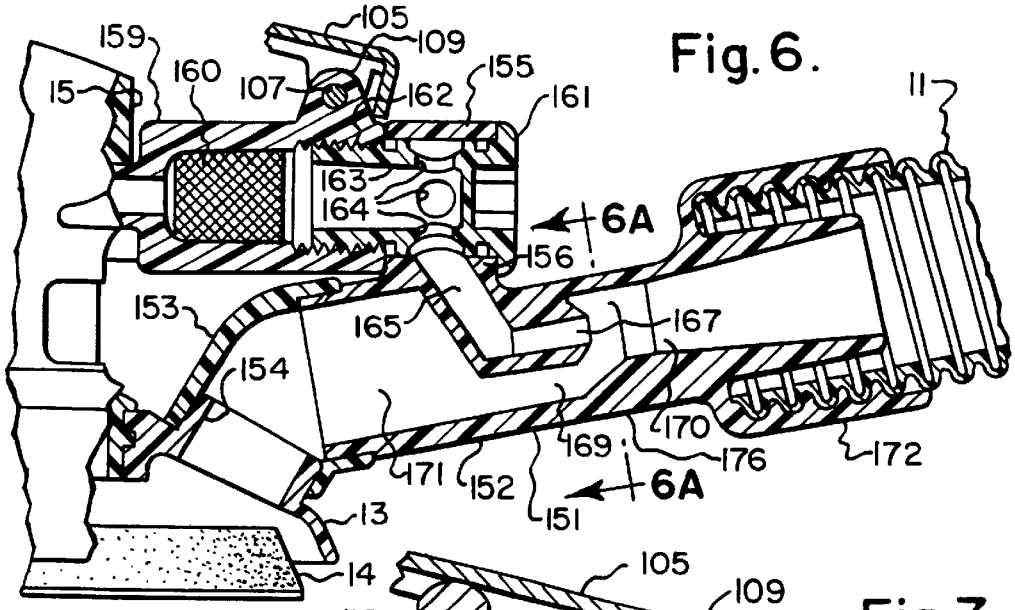
Fig. 6.
105
109
159
160
107
162
155
161
15
11
163
164
6A
156
153
165
167
154
170
169
176
172
171
152
6A
151
13
14
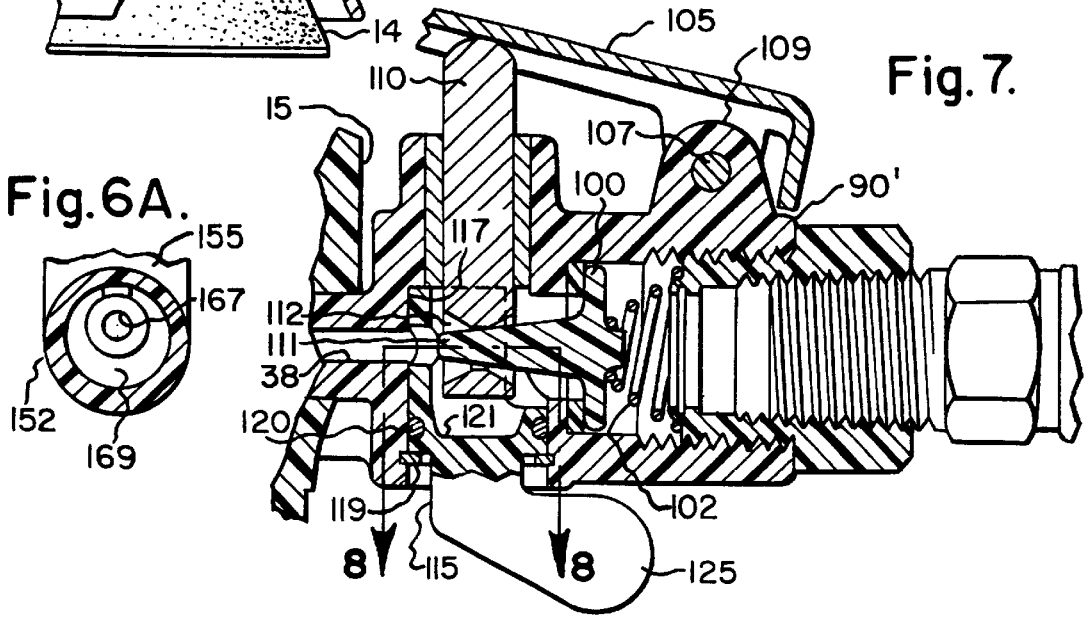
Fig. 7.
105
109
110
15
107
100
90'
117
112
111
38
120
121
119
102
8
115
8
125
Fig. 6A.
155
167
152
169
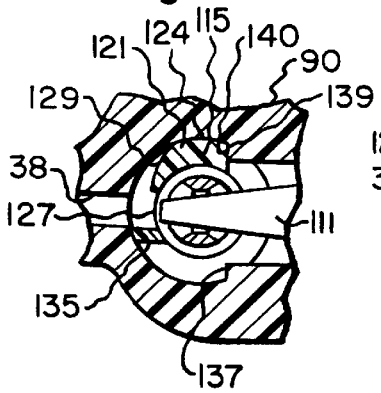
Fig. 8.
121
124
115
140
90
129
139
38
127
111
135
137
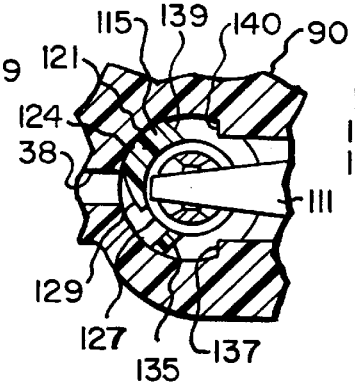
Fig. 9.
115
139
140
90
121
124
38
111
129
127
135
137
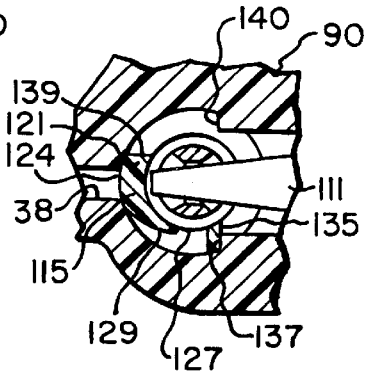
Fig. 10.
140
90
139
121
124
111
38
135
115
129
127
137

Fig. 11.
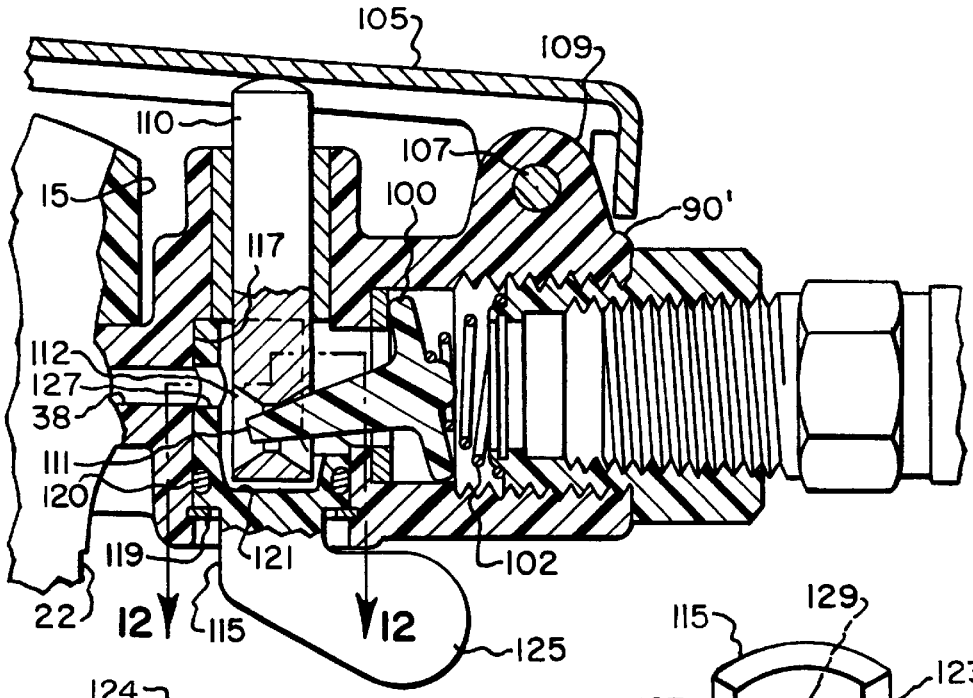
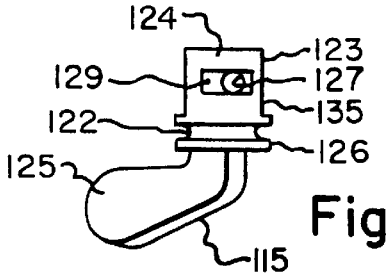
Fig. 11B.
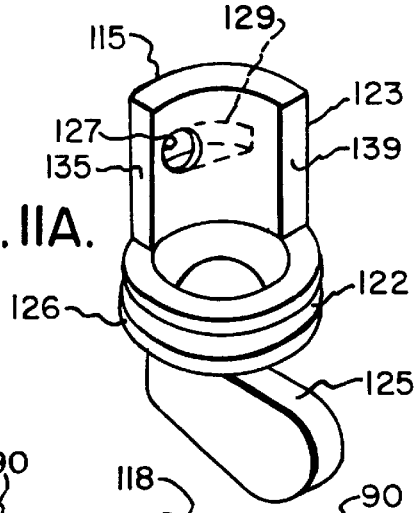
Fig. 11A.
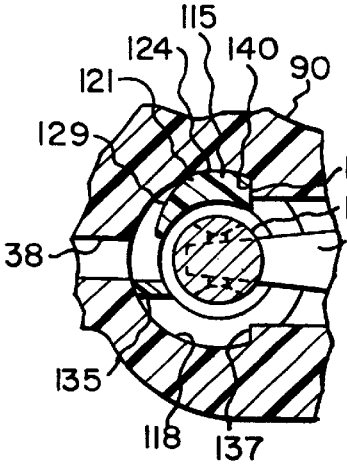
Fig. 12.
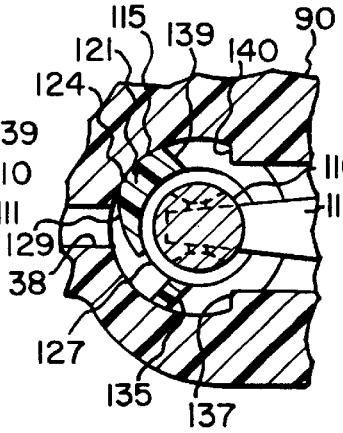
Fig. 13.
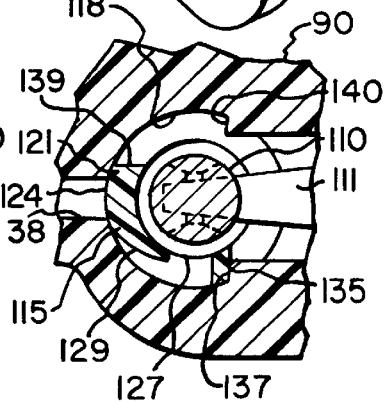
Fig. 14.

ERGONOMICALLY FRIENDLY RANDOM ORBITAL SANDER CONSTRUCTION

The present application is a continuation of application Ser. No. 09/394,571, filed Sep. 10, 1999, now U.S. Pat. No. 6,149,511 which is a division of application Ser. No. 08/787, 873, filed Jan. 23, 1997 now U.S. Pat. No. 6,004,197.

CROSS-REFERENCE TO RELATED APPLICATIONS

Not Applicable

STATEMENT REGARDING FEDERALLY SPONSORED RESEARCH OR DEVELOPMENT

BACKGROUND OF THE INVENTION

The present invention relates to an improved ergonomically friendly surface-treating tool in which a flat surface of a rotary pad engages the surface of a workpiece for the purpose of abrading or polishing it and more particularly to an improved random orbital sander.

By way of background, in operation, random orbital sanders create forces at the sanding surface which are transmitted back to the operator's hand and arm through a lever which is the height of the random orbital sander between the face of the sanding disc and the top of the casing at the vertical centerline of the sander. Therefore, if this height is as short as possible, the operator's effort in overcoming the forces produced at the face of the sanding disc are less than if the height was greater. In addition, there is a second force which must be overcome by the operator, namely, the force produced by the flexible dust discharge hose which acts through a lever arm having a length between the vertical centerline of the orbital sander and the outer end of the dust discharge fitting which conveys dust from the shroud. When any one of the foregoing two dimensions are lessened, the effort required by the operator in using an orbital sander is accordingly lessened. Also, it has been observed that lower heights of the compressed air inlet connection and the dust discharge tube outlet above a sanding surface result in less effort to operate the sander. When all of the foregoing distances are lessened, the effort involved in using the orbital sander is all the more lessened.

Furthermore, in the past the outer end of the dust discharge tube always accepted a flexible dust carrying hose at a horizontal attitude. This had the disadvantage that the horizontal dust carrying hose could droop downwardly and contact external bodies relatively close to the sander with the attendant creation of frictional drag which the operator had to overcome. In addition, when the outer end of the dust discharge tube was relatively far from the vertical centerline of the sander there was a relatively long lever arm through which the force created by the flexible hose at the outer end of the dust discharge tube acted.

In addition, insofar as known, in the past a fitting was utilized at the outer end of the dust discharge tube which effectively increased the length of the dust discharge tube and thus increased the dimension between the vertical center-line of the sander and the outer end of the dust discharge fitting with the attendant increase of the lever arm through which the force exerted by the flexible dust discharge tube acted.

In addition, insofar as known, the compressed air inlet valve structure was not capable of providing small increments of adjustment to the rotary speed of the sander.

BRIEF SUMMARY OF THE INVENTION

It is one object of the present invention to provide an improved random orbital sander which possesses a plurality of structural features which include a relatively low height and a relatively short inclined dust discharge tube which contribute toward making the sander ergonomically friendly.

Another object of the present invention is to provide an improved random orbital sander which possesses the structural characteristics of the immediately preceding paragraph and also possesses a lower compressed air inlet which further contributes toward making the sander ergonomically friendly.

A further object of the present invention is to provide an improved random orbital sander in which the relatively short dust discharge tube is angled upwardly, thereby further contributing to the ergonomically friendliness of the sander.

A still further object of the present invention is to provide an improved compressed air inlet valve construction which permits small increments of adjustability of the speed of the orbital sander.

Yet another object of the present invention is to provide the dust discharge fitting which is attached to the shroud with an outer end which is internally threaded which receives a flexible hose directly without requiring a special fitting mounted at the outer end of the dust discharge fitting, thereby shortening the lever arm through which the connected end of the flexible hose acts.

Other objects and attendant advantages of the present invention will readily be perceived hereafter.

The present invention relates to a surface-treating tool comprising a housing, a motor having a vertical axis in said housing, a pad coupled to said motor, a face on said pad extending substantially perpendicularly to said vertical axis, a shroud surrounding said pad, an opening in said shroud, a dust discharge tube having an inner end in communication with said opening, and an outer end on said dust discharge end extending at an acute angle to said face of said pad.

The present invention also relates to a surface-treating tool comprising a housing having a top, an air motor having a vertical axis in said housing, said motor including a cylinder and rotor and end plates and a shaft, an eccentric on said shaft, and a pad having a face coupled to said eccentric, said surface-treating tool having a height along said vertical axis between said top and said face of said pad which is less than about 86 millimeters.

The present invention also relates to a surface-treating tool comprising a housing having a top, an air motor having a vertical axis in said housing, said motor including a cylinder and rotor and end plates and a shaft, an eccentric on said shaft, and a pad having a face coupled to said eccentric, said surface-treating tool having a weight of less than about 0.75 kilograms.

The present invention also relates to a compressed air flow control valve for a surface-treating tool having a housing, an air motor in said housing, and a compressed air conduit extending through said housing in communication with said air motor, the compressed air flow control valve structure being in communication with said compressed air conduit and comprising a housing unit, a first bore having a first cylindrical wall surface in said housing unit in communication with said compressed air conduit, a valve in said first bore, a base on said valve in engagement with said first cylindrical wall surface, a second wall having an outer cylindrical surface extending outwardly from said base in complementary sliding circumferential engagement with said first cylindrical wall surface, a second bore in said second wall for selective communication with said compressed air conduit, and an inclined groove on said outer cylindrical surface extending away from said second bore.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 6 is an enlarged fragmentary cross sectional view taken substantially along line 6—6 of FIG. 5 and showing the structure of the motor exhaust tube, the dust discharge tube containing an aspirator, the connection therebetween and the connection between the dust discharge tube and the flexible hose;

FIG. 6A is a cross sectional view taken substantially along line 6A—6A of FIG. 6;

FIG. 7 is a fragmentary enlarged cross sectional view taken substantially along line 7—7 of FIG. 4 and showing the compressed air valve inlet structure;

FIG. 8 is a fragmentary cross sectional view taken substantially along line 8—8 of FIG. 7 and showing the compressed air flow adjusting valve in a full open position;

FIG. 9 is a view similar to FIG. 8 but showing the valve in a partially open position;

FIG. 10 is a view similar to FIG. 8 and showing the valve in a fully closed position;

FIG. 11 is an enlarged fragmentary enlarged cross sectional view similar to FIG. 7 but showing the compressed air inlet valve in an open position;

FIG. 11A is an enlarged perspective view of the compressed air flow control valve;

FIG. 11B is a side elevational view of the compressed air flow control valve;

FIG. 12 is a fragmentary cross sectional view taken substantially along line 12—12 of FIG. 11 and showing the relationship between the position between the compressed air inlet valve and the air flow adjusting valve when the latter is in a fully open position;

FIG. 13 is a view similar to FIG. 12 but showing the relationship when the air flow adjusting valve is in a partially open position;

FIG. 14 is a view similar to FIG. 12 but showing the relationship when the air flow adjusting valve is in a closed position;

DETAILED DESCRIPTION OF THE INVENTION

There are three basic types of random orbital sanders in use. The first and most rudimentary type is the non-vacuum type which does not have any vacuum associated with it for the purpose of conveying away the dust which is generated during a sanding operation. The second type is the central vacuum type which has a vacuum hose attached at one end to a central vacuum source and at its other end to a fitting which is in communication with the shroud of the sander so as to create a suction which carries away the dust which is generated during a sanding operation. The third type is a self-generated vacuum type wherein the exhaust air from the air motor is associated with an aspirator in communication with the shroud for carrying away the dust which is generated during a sanding operation.

Summarizing in advance, each of the foregoing types of random orbital sanders has one or more improved features of the present invention. First of all, all of the random orbital sanders have a relatively low height, which thus reduces stresses experienced by the operator. Additionally, all of the types are relatively lightweight to thereby further lessen the effort required to use it. In addition, the central vacuum type includes an inclined dust discharge tube connected to the shroud of the sander which causes the flexible discharge hose leading to the central vacuum source to be inclined at an angle away from the sander to thereby tend to avoid frictional drag of the flexible hose on surfaces adjacent to the sanding surface. Also, the flexible hose is threaded directly into the inclined dust discharge tube, thereby lessening the distance between the outer end of the dust discharge tube and the end which would normally be used if an additional fitting were required between the dust discharge tube and the flexible hose. The self-generated vacuum type has all of the foregoing structural features and in addition includes an aspirator which is in a straight line with the major portion of the dust discharge tube, thereby permitting the dust discharge tube to operate relatively efficiently.

Figure 1:
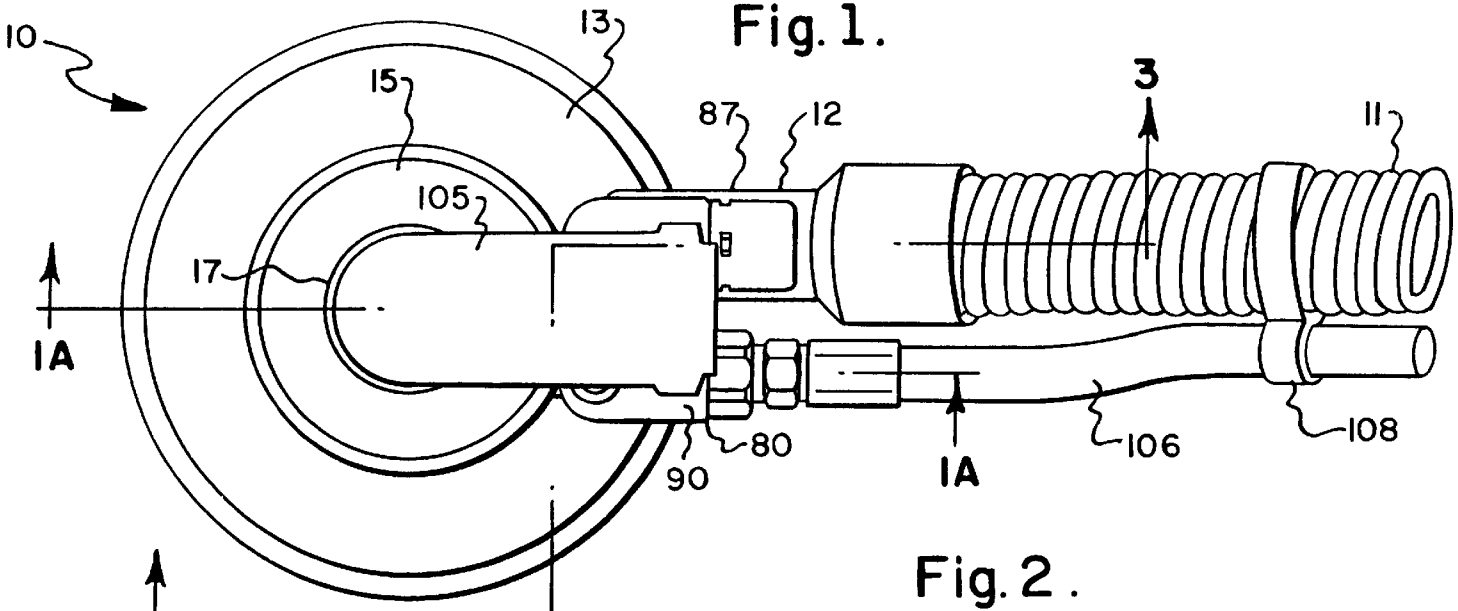
FIG. 1 is a fragmentary plan view of a central vacuum orbital sander with the vacuum hose and the compressed air hose connected to the orbital sander and to each other.
Figure 2:
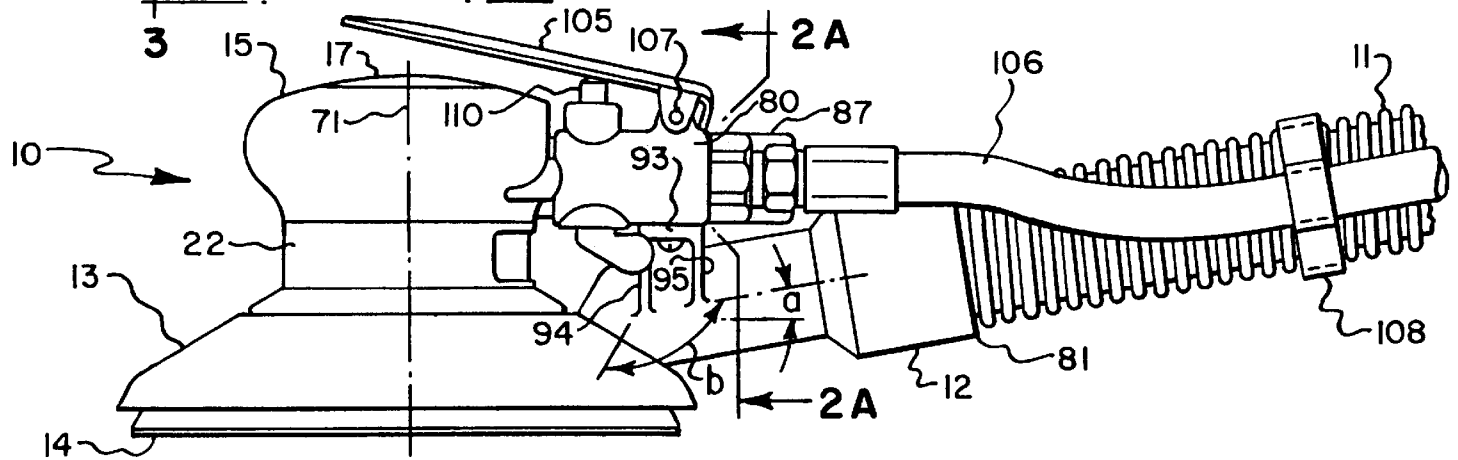
FIG. 2 is a fragmentary side elevational view of the orbital sander of FIG. 1.
Figure 1A:
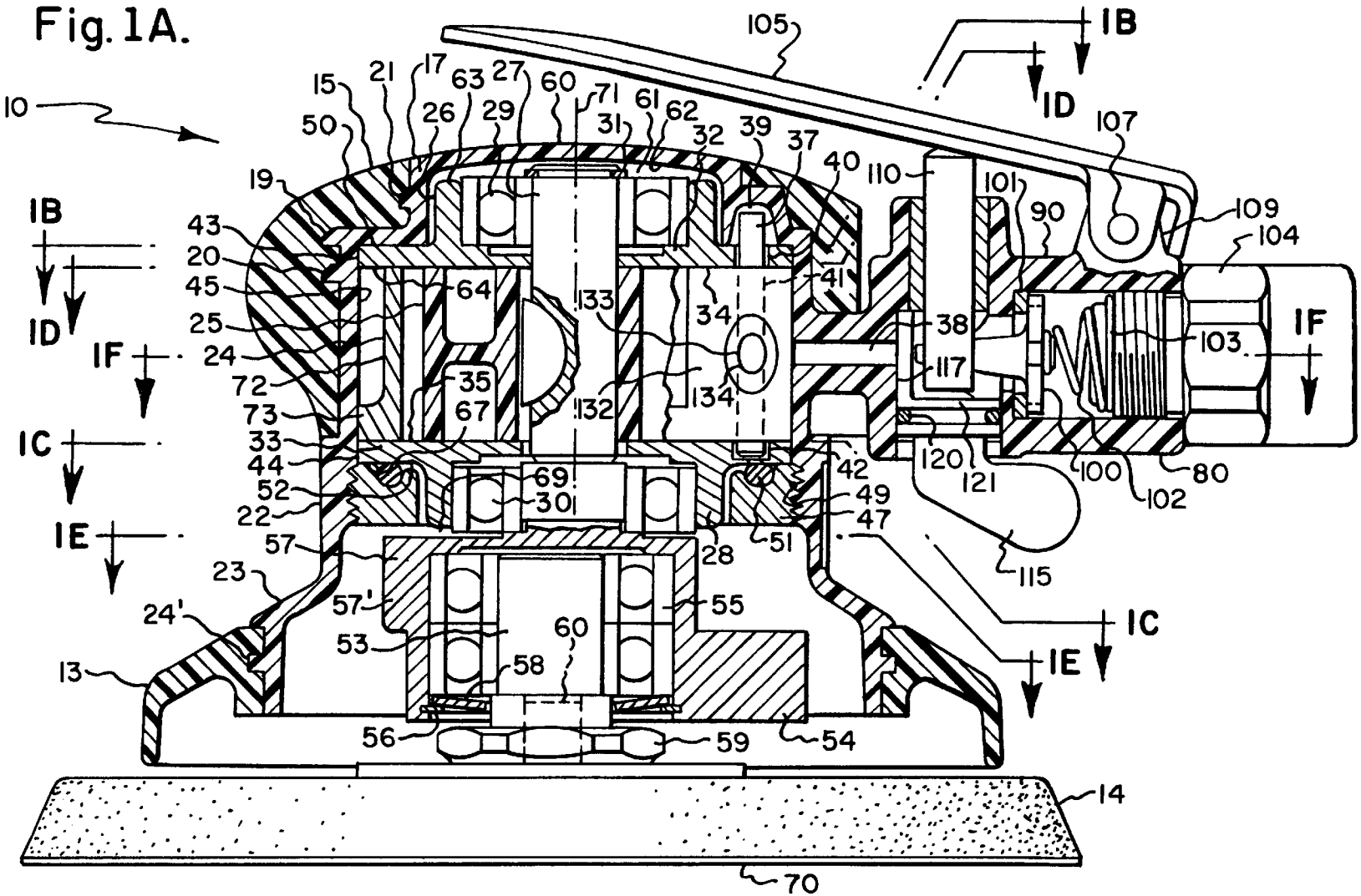
FIG. 1A is an enlarged fragmentary cross sectional view taken substantially along line 1A—1A of FIG. 1.
Figure 1B:
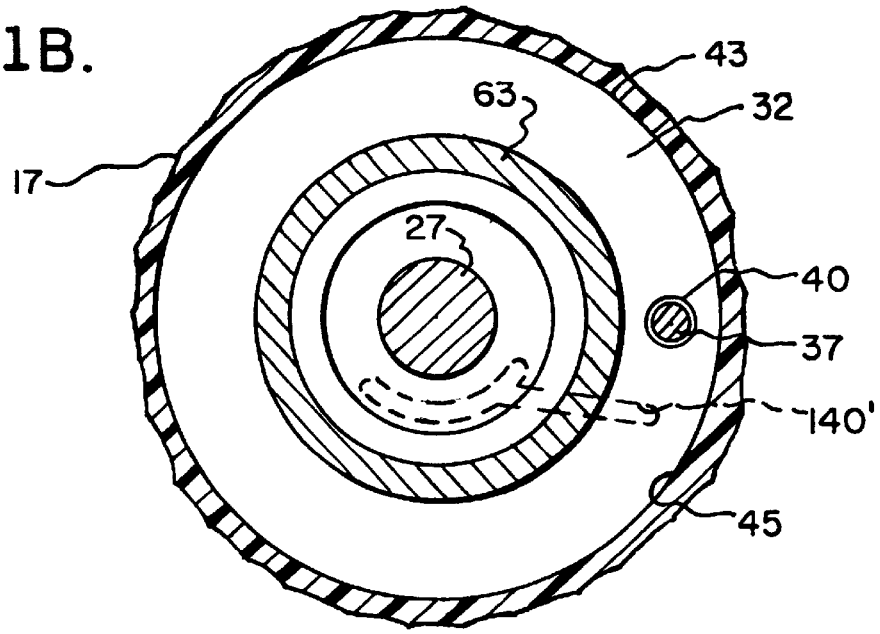
FIG. 1B is a cross sectional view taken substantially along line 1B—1B of FIG. 1A.

In FIGS. 1, 1A, 2, 2A, 2B and 3 a central vacuum type of random orbital sander 10 is disclosed wherein a flexible vacuum hose 11 is connected between the dust discharge tube 12 and the shroud 13 which surrounds the sanding disc 14. However, the only difference between the central vacuum type orbital sander 10 and a non-vacuum type is that the latter does not have the dust discharge tube 12 or the flexible hose 11. The basic structure which is common to all three types of orbital sanders is shown in FIG. 1A which is taken along line 1A—1A of FIG. 1.

The basic construction includes a housing grip 15 of a rubber type material which is mounted on plastic housing 17 and secured thereon by coacting with ribs 19, 20 and 21 which extend partially around housing 17. Housing 17 also includes a lower portion 22 which terminates at a skirt 23 having an annular rib 24' thereon onto which flexible plastic shroud 13 is mounted with a snap fit.

An air motor is located within housing 17, and it includes a cylinder 24 in which a rotor 25 keyed to shaft 27 is mounted. The ends of shaft 27 are mounted in bearings 29 and 30, and a snap ring 31 retains shaft 27 in position. The cylinder 24 is part of a cylinder assembly which includes an upper plate 32 and a lower plate 33. The bearing 29 is mounted into annular portion 63 of upper plate 32, and the bearing 30 is mounted into annular portion 30 of lower plate 33. The end plates 32 and 33 include planar surfaces 34 and 35, respectively, which bear against the ends of cylinder 24 to thereby provide the required sealing with the adjacent portions of the cylinder 24. A pin 37 has an upper end which is received in a bore 39 in housing 17. Pin 37 passes through a circular bore 40 in end plate 32 and through a bore 41 in cylinder 24 and into a bore 42 in end plate 33, thereby aligning the end plates 32 an 33 with the cylinder 24. The outer circular ends 43 and 44 of end plates 32 and 33, respectively, have a tight fit with the internal surface 45 of housing 17. A threaded lock ring 47 is threaded into tapped portion 49 of housing 17 to thus cause the upper surface 50 of end plate 32 to bear against the adjacent surface of housing 17. An O-ring 51 in a groove in lock ring 47 bears against the undersurface 52 of lower end plate 33. Rotor shaft 27 has an eccentric housing 57 formed integrally therewith into which bearing 55 is mounted and retained therein by snap ring 56 which bears on washer 58. Housing 57 is an eccentric having two counterweights 54 and 57. A stub shaft 53 is press-fitted into bearing 55 and it is formed into a nut 59 at its outer end. Thus, rotor shaft 27 will rotate and eccentric housing 57 will simultaneously rotate with shaft 27. A threaded shaft 60 extends upwardly from sanding disc 14 and is received in stub shaft 53.

Figure 1D:
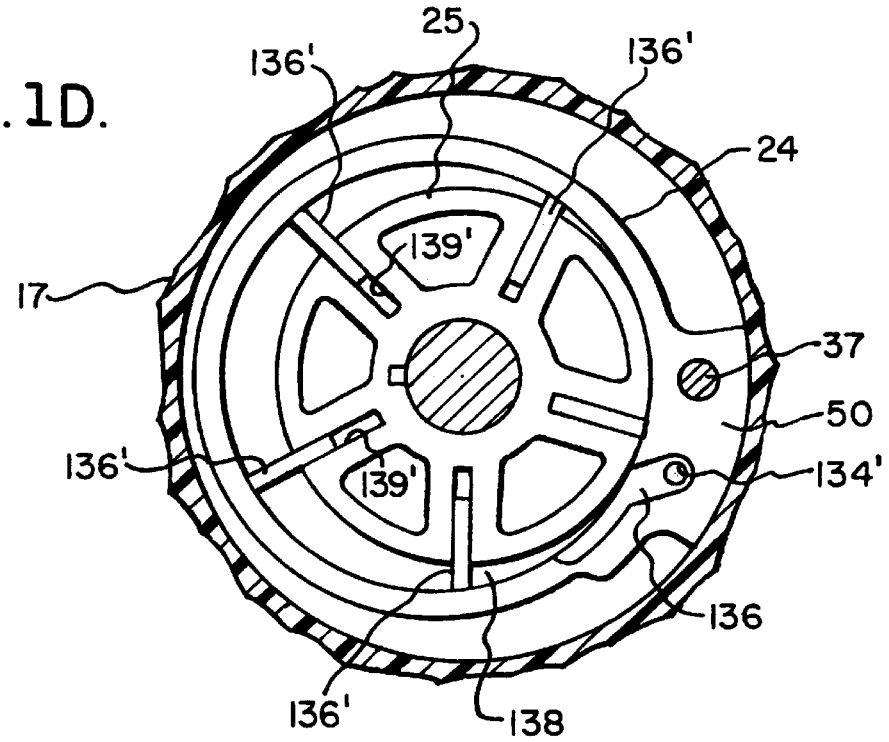
FIG. 1D is a cross sectional view taken substantially along line 1D—1D of FIG. 1A.
Figure 1C:
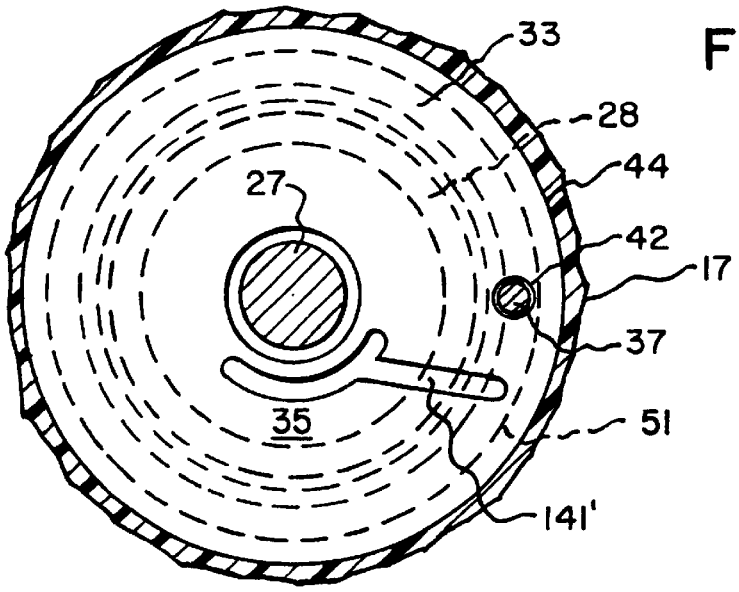
FIG. 1C is a cross sectional view taken substantially along line 1C—1C of FIG. 1A.
Figure 1E:
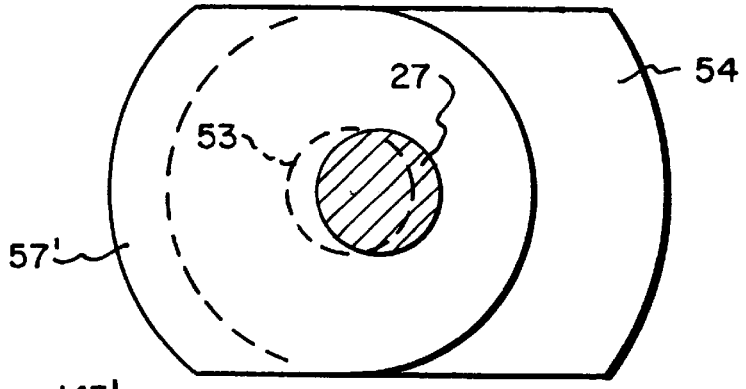
FIG. 1E is a cross sectional view taken substantially along line 1E—1E of FIG. 1A.
Figure 1F:
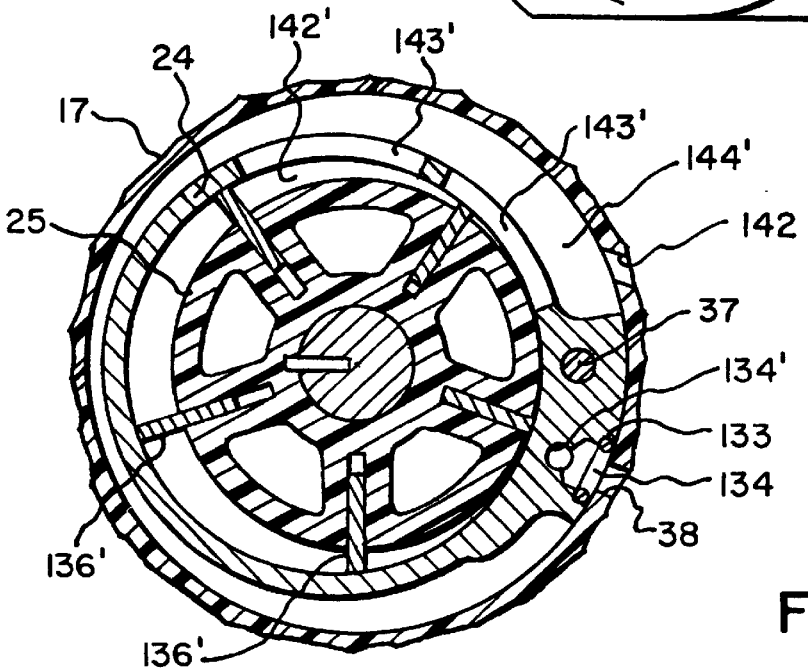
FIG. 1F is a cross sectional view taken substantially along line 1F—1F of FIG. 1A.

As can be seen from FIGS. 1A and 1F an inlet conduit 38 is in communication with bore 134 in cylinder 24, and bore 134 is in communication with bore 134' which extends axially between upper cylinder surface 50 (FIG. 1D) and lower cylinder surface 35 (FIG. 1A). Bore 134' is in communication with groove 136 in upper cylinder surface 150 and a like groove (not shown) in lower cylinder surface 35. When upper plate 32 is in assembled position, it causes groove 136 to be a conduit leading to chamber 138 within cylinder 24. Lower plate 33 forms a similar conduit with the groove which corresponds to groove 136 in lower cylinder surface 35. A plurality of vanes 136' (FIG. 1D) are slidably mounted in radial slots 139' in plastic rotor 25 and their outer ends contact the inner surface of cylinder 24 because they are forced outwardly by air pressure which is conducted to the inner ends of slots 139' by groove 140' in the surface 64 of plate 32. Groove 140' is in communication with groove 136. Lower plate 33 (FIG. 1C) has a groove 141' which corresponds to groove 140' and is in communication with a groove which corresponds to groove 136. Air is exhausted from chamber 142' of cylinder through narrow slots 143' a few millimeters wide in the central portion of cylinder 24, and this exhaust air passes into chamber 144' between cylinder 24 and housing 17, and it thereafter passes through bore 142 (FIGS. 1F and 3) into exhaust conduit 87.

Figure 5:
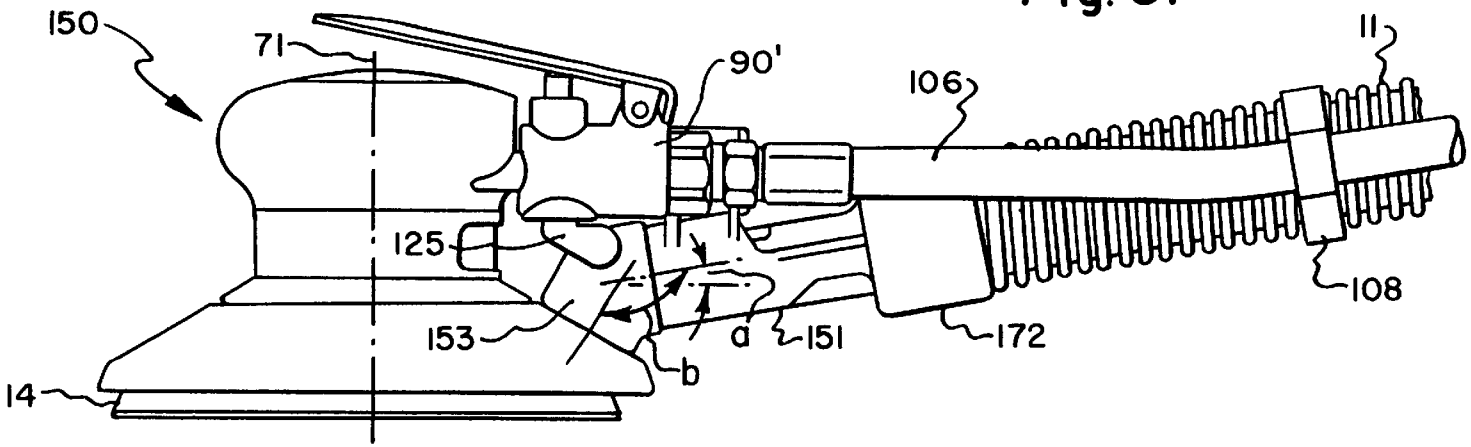
FIG. 5 is a fragmentary side elevational view of the sander of FIG. 4.

At this point it is to be noted that the air motor is of a conventional type which has been constructed for causing the overall height of the above-described unit in FIG. 5 to be lower than existing orbital sanders having a similar construction and for causing it to have a lower weight.

The modifications which have been made are as follows: The top 60 of housing 17 is 2.0 millimeters thick. Additionally, the clearance at 61 between the inner surface 62 of housing 17 and the edge 63 is 0.6 millimeters. In addition, the thickness of end plate 32 between surface 50 and surface 64 is 2.5 millimeters, and the thickness of end plate 33 between surface 35 and surface 67 is 2.5 millimeters. The cylinder 24' has an axial length of 20 millimeters. In addition, the clearance 69 is 0.5 millimeters. Also, nut 59 is 4.0 millimeters thick. The eccentric has a height of 21.4 millimeters. All of the foregoing dimensions have caused the air motor to have a height of 82.92 millimeters from the top of housing 17 to the face 70 of pad 14 at the vertical center-line 71. This compares to the lowest known existing prior art structure which has a height of approximately 89 millimeters to thereby reflect a difference of 6.08 millimeters or approximately 7%. In addition, the use of aluminum end plates 32 and 33, rather than steel, plus having the outer surface 72 of cylinder 24 to be 2 millimeters and the absence of an upper flange which corresponds to flange 73 and the thinning of aluminum end plate 33 and the thinning of nut 59 reduces the weight of the orbital sander of FIG. 5 to 0.68 kilograms as compared to a similar prior art sander which has a weight of 0.82 kilograms, thereby reflecting a difference of approximately 0.14 kilograms or about 17%. As noted above, the lesser weight makes it easier for a person to handle the orbital sander.

As noted above, the air motor is a well known conventional type having 150 watts minimum power at 0.61 bar air pressure minimum. The above features of the presently described air motor cause the orbital sander to be of a relatively low height and a relatively low weight. Otherwise, the internals of the air motor are conventional.

Figure 15:
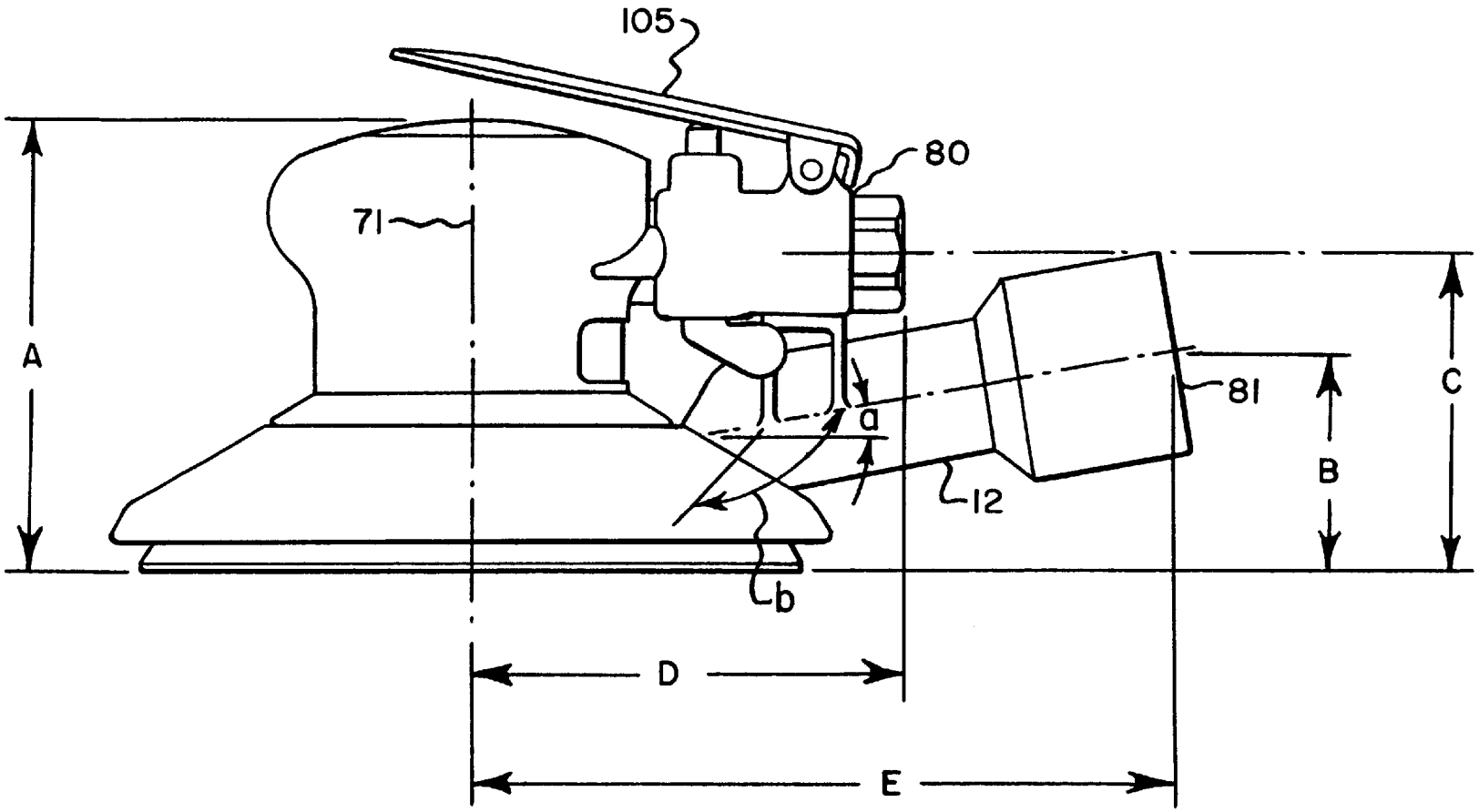
FIG. 15 is a side elevational view of a central vacuum type orbital sander showing the various dimensions which are considered in determining ergonomics.

The reduced height of sander 10 is depicted by letter A in FIG. 15. The fact that the entire height of sander 10 is lower, results in the lowering of the centerline of the outlet of the dust discharge tube to a dimension B and also results in the lowering of the centerline of the compressed air inlet 80 to a dimension C. As noted above, the lowering of dimensions B and C also results in enhancing the ease of handling of the orbital sander 10.

Figures 2A, 2B, 3:
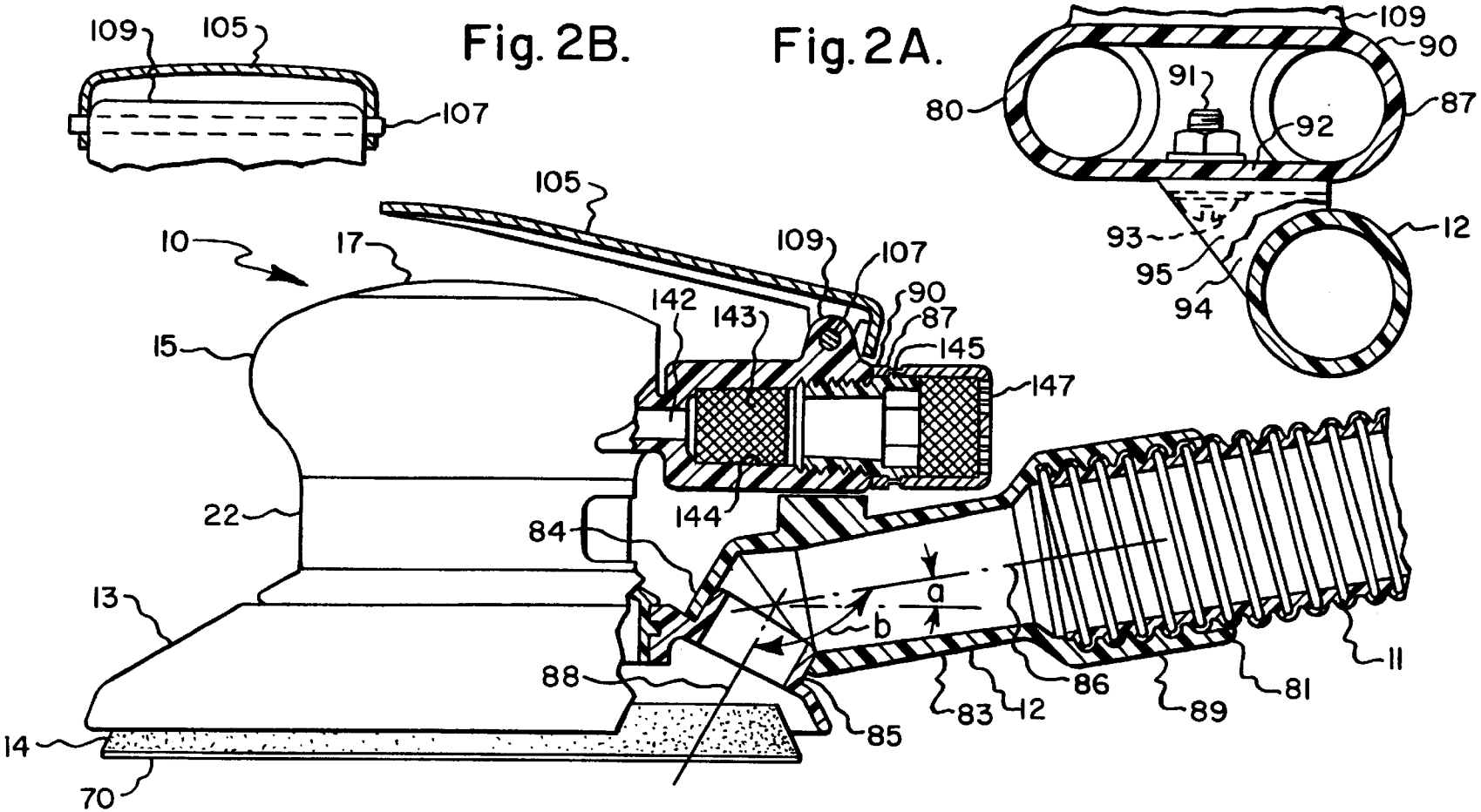
FIG. 2A is a fragmentary cross sectional view taken substantially along line 2A—2A of FIG. 2 and showing the support structure for the dust discharge tube.
FIG. 2B is a fragmentary extension of the top of the structure shown in FIG. 2A.
FIG. 3 is a fragmentary view, partially in cross section, taken substantially along line 3—3 of FIG. 1, and showing the relationship between the shroud and the dust discharge tube and the discharge hose; and also showing the relationship between the motor exhaust tube and the dust discharge tube.
Figure 4:
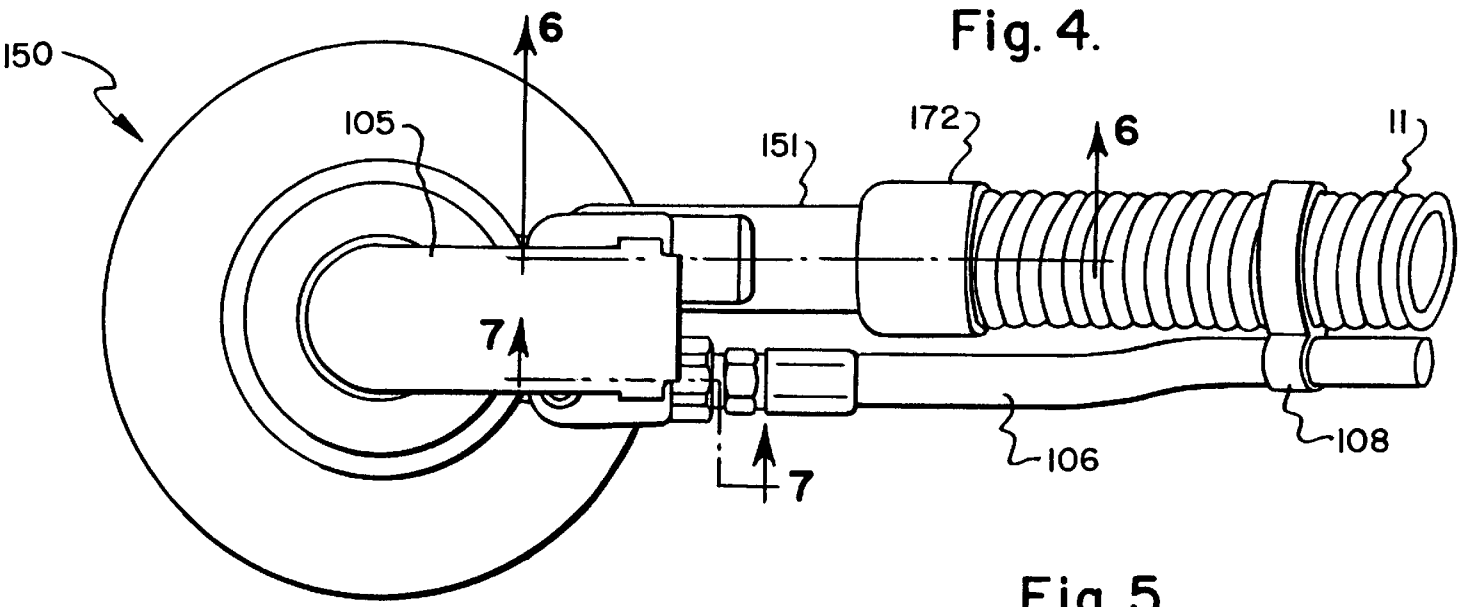
FIG. 4 is a fragmentary plan view of a self-generated vacuum orbital sander with the vacuum hose and the compressed air hose connected to the orbital sander and to each other.

In accordance with another aspect of the present invention, the dust discharge tube 12 (FIG. 3) of sander 10 has a centerline 86 and is inclined to the horizontal at an angle a. The dust discharge tube 12 consist of a longer section 83 and a shorter section 84 which has a centerline 88 and which has a circular outlet which mounts on cylindrical stub pipe 85 formed integrally with shroud 13. The dust discharge tube portion 83 is located immediately below the motor exhaust inlet fitting 87. The air motor exhaust conduit 87 is within housing portion 90 which is molded integrally with housing 17. Housing portion 90 also contains compressed air inlet conduit 80 (FIGS. 1 and 2A). The dust discharge tube 12 is also attached to housing portion 90 by a bolt 91 which extend through horizontal portion 92 of unit 90 and also extends through web 93 which spans legs 94 and 95 molded integrally with dust discharge tube 12. Thus, dust discharge tube 12 is firmly supported on stub tube 85 and on housing portion 90 which contains the air motor exhaust conduit 87 and the compressed air inlet 80.

As noted briefly above, since the outer end portion 89 (FIG. 3) of dust discharge tube 12 is inclined upwardly, the adjacent portion of flexible vacuum hose 11 will also be inclined upwardly to thus cause it to droop further away from the outlet 89 then if the latter was horizontal. This tends to lessen the possibility that the flexible hose will contact the workpiece which could create a frictional drag. In addition, as can be seen from FIG. 2, since the flexible hose 11 is received directly in dust discharge tube 12, a fitting which is otherwise used at the outer end of a dust discharge tube in the prior art is eliminated which thus causes the extreme outer end 81 of discharge tube 12 to be at a distance E (FIG. 15) from the vertical centerline 71 of the sander. It will be appreciated that the shorter that the distance E is, the shorter is the lever arm tending to tilt the sander 10 and thus for any given weight at the outer end 81 of dust discharge tube 12, the shorter the lever arm E is, the lower will be the tilting force which is produced and the lower will be the force required by the operator to overcome this tilting force.

In accordance with another aspect of the present invention, the compressed air inlet structure permits a very gradual varying of the pressure which is supplied to the air motor. In this respect, the compressed air inlet 80 includes a valve 100 (FIG. 1A) which is biased against seat 101 by spring 102 which has its outer end 103 bearing against the end of hollow compressed air fitting 104 which is threaded into housing portion 90. Fitting 104 (FIGS. 1, 2, 4 and 5) receives the end of compressed air hose 106 with a conventional connection. Hose 106 is attached to vacuum hose 11 by strap 108. In order to open valve 100 from the position shown in FIGS. 1A and 7 to the position shown in FIG. 11, lever 105 is pivotally mounted at 107 on boss 109 which is molded integrally with housing portion 90. When lever 105 is depressed, it will depress pin 110 from the position shown in FIG. 7 to the position shown in FIG. 9 against the bias of spring 102 in view of the fact that the extension 111 of valve 100 is received in a bore 112 at the lower end of pin 110. When lever 105 is released, the spring 102 will return valve 100 to the position of FIG. 7 and pin 110 will be raised to the position of FIG. 7 by virtue of its connection with valve extension 111. The foregoing structure of valve 100 is conventional.

In accordance with the present invention, an improved flow adjusting valve 115 (FIGS. 1A, 7, 11A and 11B) is located in bore 117 of housing portion 90 and it is retained therein by snap ring 119 (FIG. 7). Bore 117 has a wall 118. An O-ring 120 is mounted in a groove 122 of base 126 of valve body 121 (FIG. 11A). O-ring 120 performs both a sealing function and a frictional holding function to retain valve 115 in any adjusted position in bore 117. The valve consists of a portion 123 of a cylinder extending upwardly from base 126 and having an outer cylindrical surface 124. A handle 125 is molded integrally with valve body 121. The upstanding wall 123 includes an aperture 127 and an inclined groove 129 in communication with bore 127. The outer surface 124 is in sliding contact with wall 130 of bore 117. When valve 121 is in a fully open position shown in FIG. 8, bore 127 is in communication with bore 38 (FIG. 1A) of housing 17. Bore 38 terminates at wall 132 of air motor cylinder 25. An O-ring 133 is inserted in wall 132 (FIG. 1F) around bore 134 which provides a seal with the outer end of conduit 38. The foregoing structure is well known in the art.

As noted above, valve 115 is fully open in the position shown in FIG. 8. In FIG. 9 it is partially open and it can thus be seen that the air flow must pass along inclined groove 129 which restricts the opening to conduit 38. It will be appreciated that the more that wall 121 is moved in a counterclockwise direction, the smaller will be the path of communication leading to duct 38. In FIG. 10 the valve is shown in a fully closed position wherein the wall 124 completely closes off duct 38. At this time the edge 135 engages shoulder 137 to define the limit of counterclockwise movement of valve 115, as shown in FIG. 10. The clockwise limit of movement of wall 124 is determined when edge 139 engages shoulder 140, as shown in FIG. 10. The range of movement of valve 125 is 90° from a full open position to a full closed position.

FIGS. 12, 13 and 14 correspond to FIGS. 8, 9 and 10, respectively, but are taken along cross section line 12—12 above valve extension 111 whereas FIGS. 8, 9 and 10 are taken through valve extension 111 in FIG. 7.

In FIG. 3 motor air exhaust housing 87 is shown which is in communication with the exhaust of air motor cylinder 24 (FIG. 1A) through conduit 142 (FIG. 3). Housing 90 includes a muffler 143 which is held in position in bore 144 by plug 145 and the exhaust air exits housing 90 through perforated cap 147.

In FIGS. 4, 5, 6 and 7 a self-generated vacuum random orbital sander 150 is shown. This sander has the same internal structure described above relative to the central vacuum type, as shown in FIG. 1A. In addition, it has the same type of sanding pad 14 and it has the same type of valve 115 described above which is located in housing unit 90. The inlet valve 115 is identical to valve 125 described above in FIGS. 1A, 8, 9 and 10.

In accordance with another aspect of the present invention, the self-generated vacuum random orbital sander 150 includes a dust discharge tube 151 which is also inclined to the horizontal at an angle a (FIG. 5). Dust discharge tube 151 includes an elongated portion 152 which has a centerline 156 (FIG. 16) and is received in elbow 153 which has a centerline 158 and which in turn is mounted on stub pipe 154 of shroud 13. A tubular strap portion 155 is formed integrally with portion 156. Motor exhaust unit 159 contains a porous muffler 160. A fitting 161 extends through strap 155 and is threaded into motor exhaust housing 159 at 162 and it includes a bore 163 and a plurality of apertures leading from bore 163 to conduit 165 which is the entry portion of bore 167 which functions as an aspirator 176 in conjunction with the areas 169 and 170 of elongated dust discharge tube portion 150. It is to be especially noted that the dust discharge from shroud 13 enters the straight portion of dust discharge tube 152 and the fact that there is no sharp bend in the immediate vicinity of areas 171 and 169, there will be greater efficiency than if such a bend existed immediately adjacent to conduit 165.

In addition to the foregoing, the flexible dust discharge hose 11 is received in the enlarged portion 172 at the outer end of dust discharge tube 151 in the same manner as described above relative to the embodiment of FIGS. 1–3. The outer portion 170 of aspirator 176 is nested within the innermost portion of dust discharge hose 11 (FIG. 6), thereby contributing to the overall relative shortness of dust discharge tube 151.

It is to be noted that the dust discharge tube 151 is inclined at an angle a to the horizontal and that elbow 153 is inclined at an angle b to the horizontal.

Figure 16:
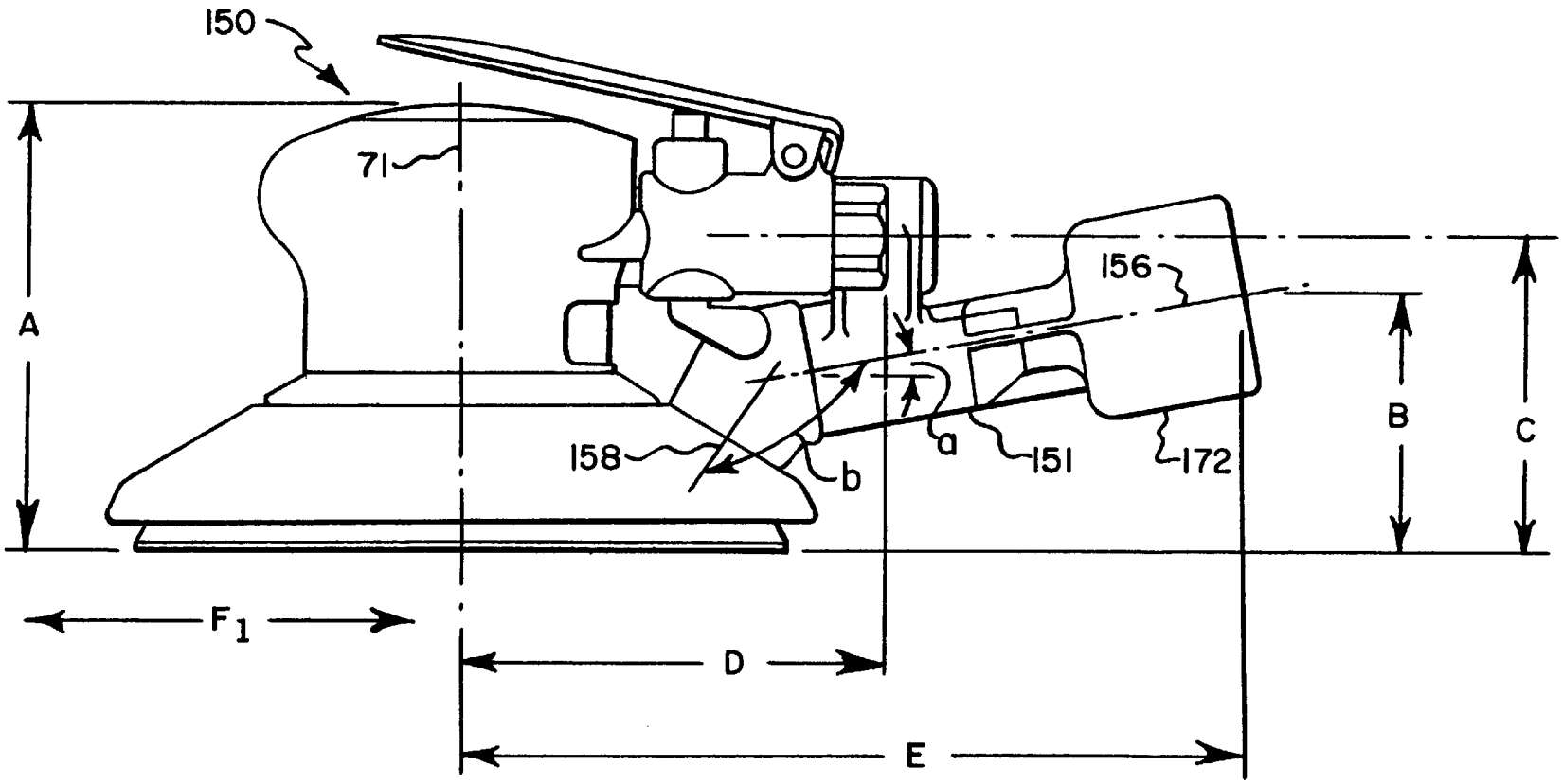
FIG. 16 is a side elevational view of a self-generated vacuum type of orbital sander showing the various dimensions which are considered in determining ergonomics.

It is to be further noted from FIG. 16 that the centerline of dust discharge tube 151 at the outer end of portion 172 is a distance E from the vertical centerline 71 of the random orbital sander 150. Dust discharge tube 151, in addition to being inclined, is relatively short so that any downward force at its outer end will be relatively close to the vertical centerline 71 and will therefore create less of a force which the operator must oppose than if it were longer.

The following table sets forth the dimensions A through E and angles a and b shown in FIGS. 15 and 16.

TABLE

DIMENSIONS IN MILLIMETERS OF VARIOUS PORTIONS OF DIFFERENT TYPES OF ORBITAL SANDERS

| | NON-VACUUM | SELF-GENERATED VACUUM | CENTRAL VACUUM |
|---|---|---|---|
| A | 82.92 | 82.92 | 82.92 |
| B | — | 47.45 | 40.42 |
| C | 58.42 | 58.42 | 58.42 |
| D | 80.00 | 80.00 | 80.00 |
| E | — | 147.28 | 130.05 |
| Angle a | — | 10° | 10° |
| Angle b | — | 130° | 130° |

A is the height between top of sander and sanding disc pad surface at vertical centerline of sander.
B is the height between centerline of discharge tube and sanding disc pad surface at outlet of discharge tube.
C is the height between centerline of compressed air inlet and sanding disc pad surface.
D is the horizontal distance between vertical centerline of sander and extreme outer portion of compressed air inlet.
E is the horizontal distance between vertical centerline of sander and extreme outer portion of the dust discharge tube.
Angle a is the angle between the horizontal, or the face of the pad, and the centerline of the dust discharge tube.
Angle b is the angle between the centerlines of the two portions of the dust discharge tube.

In the above table, the dimension E is 130.05 millimeters for the central vacuum sander and 147.28 millimeters for the self-generated vacuum sander. However, if the threaded connection at outer end portion 89 (FIG. 3) of dust discharge tube 12 of the central vacuum sander is decreased by two threads at 5 millimeters each, then the 130.05 dimension E would be decreased about 10 millimeters to about 120 millimeters. Also, if the threaded end portion 172 of the self-generated vacuum sander is decreased by two threads at 5 millimeters each, the 147.28 dimension E would be decreased 10 millimeters to about 137 millimeters. It is possible with a slight loss of ergonomics to lengthen the dimension E for the central vacuum and self generated vacuum sanders by about 10 millimeters to about 140 millimeters and about 157 millimeters, respectively. However, when the foregoing lengthened dimensions E are considered in combination with the lower height dimension A, each of the foregoing sanders will still be more ergonomically friendly than sanders not having this combination of dimensions.

As noted briefly above, the closest known prior art sander of the above-described type has a height dimension of approximately 89 millimeters as compared to height dimension A of 82.92 millimeters of the above-described sander. As further noted above there is a difference of about 7% between the two dimensions. The 82.92 millimeter dimension is the ultimate low dimension which was able to be achieved while still retaining the various component parts of the sander in a commercially operable manner for providing the desired output parameters noted above and also recited hereafter. However, it will be appreciated that the height dimension A of the present sander can be increased a few millimeters by not reducing the thickness and height of the various components as much as was done. Accordingly, it is contemplated that the height dimension A can be increased to 86 millimeters which would still be a reduction in height from 89 millimeters or approximately 3.5%.

Additionally, as noted above the closest known prior art sander of the present type has a weight of 0.82 kilograms as compared to the weight of the present sander of 0.68 kilograms, or a difference of 0.14 kilograms or a weight reduction of approximately 17%. It will be appreciated that the weight of the sander of the present invention may be increased to 0.75 kilograms which would be a difference of approximately 0.07 kilograms, and this would be a weight reduction of approximately 8.3% which also could be significant.

The preferred angle a shown above in the table is an acute angle of 10°. However, this angle may be as small as about 5° and as high as about 30°. The exact acute angle for any specific device will depend on various factors such as the length of the motor exhaust body which is located directly above it and the vertical spacing between the shroud outlet and the motor exhaust body.

As noted above, the angle b is 130°, but it can be any obtuse angle consistent with the acute angle a of the dust discharge tube.

The non-vacuum sander, the central vacuum sander 10 and the self-generated vacuum sander 150 utilize a 150 watt power air motor which operates from a source providing 6.1 bar air pressure and the air motor is capable of providing up to 10,000 revolutions per minute.

While preferred embodiments of the present invention have been disclosed, it will be appreciated that it is not limited thereto but may be otherwise embodied within the scope of the following claims.

What is claimed is:

1. A random orbital sander comprising a housing having a top, an air motor having a vertical axis in said housing, said motor including a cylinder, a rotor within said cylinder, end plates on opposite sides of said cylinder, a shaft mounted in bearings in said end plates, said shaft being keyed to said rotor, an eccentric on said shaft, a pad having a face coupled to said eccentric, said surface-treating tool having a height along said vertical axis between said top and said face of said pad which is less than about 86 millimeters, and said air motor being capable of providing up to 10,000 revolutions per minute.

2. A random orbital sander as set forth in claim 1 wherein said surface-treating tool has a height of about 83 millimeters.

3. A random orbital sander as set forth in claim 1 wherein said sander has a weight of less than about 0.75 kilograms.

4. A random orbital sander as set forth in claim 1 wherein said weight is about 0.68 kilograms.

5. A random orbital sander as set forth in claim 3 wherein said sander has a height of about 83 millimeters.

6. A random orbital sander as set forth in claim 5 wherein said weight is about 0.68 kilograms.

7. A random orbital sander as set forth in claim 1 wherein said air motor operates at 150 watts minimum power.

8. A random orbital sander as set forth in claim 7 wherein said surface-treating tool has a height of about 83 millimeters.

9. A random orbital sander as set forth in claim 7 wherein said surface-treating tool has a weight of less than about 0.75 kilograms.

10. A random orbital sander as set forth in claim 7 wherein said weight is about 0.68 kilograms.

11. A random orbital sander as set forth in claim 9 wherein said surface-treating tool has a height of about 83 millimeters.

12. A random orbital sander as set forth in claim 11 wherein said weight is about 0.68 kilograms.

13. A random orbital sander comprising a housing having a top, an air motor having a vertical axis in said housing, said motor including a cylinder, a rotor within said cylinder, end plates on opposite sides of said cylinder, a shaft mounted in bearings in said end plates, said shaft being keyed to said rotor, an eccentric on said shaft, a pad having a face coupled to said eccentric, said surface-treating tool having a weight of less than about 0.75 kilograms, and said air motor being capable of providing up to 10,000 revolutions per minute.

14. A random orbital sander as set forth in claim 13 wherein said air motor operates at 150 watts.

15. A random orbital sander as set forth in claim 14 wherein said weight is about 0.68 kilograms.

16. A random orbital sander as set forth in claim 13 wherein said weight is about 0.68 kilograms.

* * * * *